United States Patent [19]

Duffy

[11] 4,429,688

[45] Feb. 7, 1984

[54] MEDICAL APPLIANCE FOR PERCUSSIVE RESPIRATORY THERAPY

[76] Inventor: Peter B. Duffy, 4639-1/2 Tujunga, North Hollywood, Calif. 91602

[21] Appl. No.: 213,818

[22] Filed: Dec. 8, 1980

[51] Int. Cl.[3] ..... A61H 31/00

[52] U.S. Cl. ..... 128/28; 128/54; 128/67

[58] Field of Search ..... 128/28, 38, 67, 54, 128/55

[56] References Cited

U.S. PATENT DOCUMENTS

| | | | |
|---|---|---|---|
| 401,028 | 4/1889 | Greene | 128/38 |
| 713,761 | 11/1902 | Harlan | 128/38 |
| 728,003 | 5/1903 | Pfanschmidt et al. | 128/67 |
| 1,460,927 | 7/1923 | Thompson et al. | 128/38 |
| 2,259,817 | 9/1942 | Winther | 128/38 |
| 2,280,624 | 4/1942 | Buckley | 128/67 |
| 2,959,167 | 11/1961 | Leclabart | 128/67 |
| 4,196,722 | 4/1980 | Vanderwoude | 128/38 |

FOREIGN PATENT DOCUMENTS

| | | | |
|---|---|---|---|
| 166187 | 12/1949 | Australia | 128/38 |

*Primary Examiner*—Richard C. Pinkham
*Assistant Examiner*—T. Brown
*Attorney, Agent, or Firm*—Allston L. Jones

[57] ABSTRACT

A medical appliance for use in percussive respiratory therapy comprises a partially enclosed cavity which presents a substantially circular opening bordered by an annular ring of moldably compressible material for effecting a pneumatic seal of the cavity to a body area against which it is placed. The annular ring defines a groove to communicate with a curling semi-circular lip, the ring also defining a cavity filled with a compressible gaseous vapor for cushioning the impact of the appliance with a patients's body.

2 Claims, 7 Drawing Figures

MEDICAL APPLIANCE FOR PERCUSSIVE RESPIRATORY THERAPY

BACKGROUND AND SUMMARY

Percussive techniques in respiratory therapy are increasingly ordered by physicians. Patients recovering from surgery are treated with percussive techniques to prevent or minimize the onset of pneumonia or atelectasis. It is also ordered to prevent or treat the occurrence of emphysema, chronic bronchitis, cystic fibrosis, asthma, and other respiratory ailments. Percussion can be ordered in many ways, i.e., CPT or chest physiotherapy, which consists of percussion during postural drainage including coughing and/or suctioning. PVD or percussion vibration and drainage and PVS or percussion vibration and suctioning. Also used prior to percussive therapy are various inhaled medications including broncho-dilators, mucolytics and corticosteroids.

An important part of percussive techniques is administering the therapy to specific focal points on the chest wall. This procedure is also known as cupping and clapping since the therapist cups his or her hand against the patient's chest wall in rapid succession. This previous technique of using the hands had several disadvantages e.g., the direct contact of the percussor's hand with the patient's body, who may have open wounds or sores creating increased risk of contamination and infection. It was also very difficult to focus percussion on body areas where there were intravenous devices (IV), cardiac monitoring devices, chest tubes and lines for equipment or the like.

Furthermore, the hand of the therapist was really too large to properly percuss neonates and small children, since the adult hand is too large to contact only areas of specific location.

Also, there are many areas of the body which the respiratory therapist must avoid striking, e.g., kidney, spine, and breast. Therefore, complete percussive therapy could be severely limited between those areas which were occluded due to medical equipment and its attachments or sensitive body areas which had to be avoided. When it was impossible to use the hand, nurses and therapists frequently used or adapted whatever was nearby.

Therefore, in accordance with the preferred embodiments of the present invention, a hand held medical appliance comprises a partially enclosed cavity presenting a substantially circular opening bordered by an annular ring of moldably compressible material for effecting a pneumatic seal of the cavity to a body area against which it is placed. The important objective of the use of percussion in respiratory therapy is to transfer percussive waves into a body area, such as the lungs, to dislodge blocked mucus and allow it to move along to a point that the patient can expectorate it or spit it up. A non-skid finish is provided on the external surface of the appliance to keep the user's hand from slipping off. The embodiments increase the transfer of percussive energy into the desired body area while reducing the severity of the impact to the skin surface. This is accomplished by creating an excellent seal of the cavity of the appliance to the body surface. Also the cavity is designed to compress resiliently deform and compress in response to the impact pressure applied by the therapist. The annular moldable ring thus provides both a seal and provides some protection for the skin tissue at the contact point. Also, one could use the embodiments with pneumatic or electrically driven vibrator action to enhance the mucus loosening effect, or these embodiments can be used to percuss and then the body area could be vibrated.

DESCRIPTION OF THE PREFERRED EMBODIMENT

Figure 1:
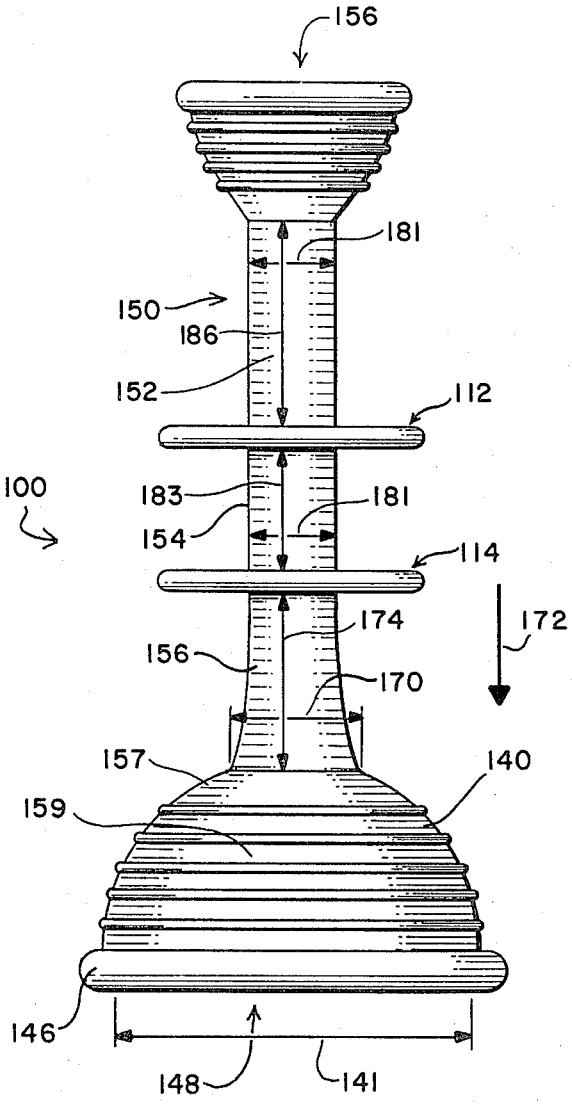
FIG. 1 is a side view of a first embodiment.

Referring now to FIG. 1, there is shown an embodiment of a percussor 100 having features of the present invention. Circular rings 112 and 114 are provided to allow the therapist to conveniently hold the percussor 100.

Assume that the therapist wished to percuss a body area by striking it with the open end 148 of cavity 140, lip 146 deforms to provide a pneumatic seal.

The therapist would place shaft portion 154 between his forefinger and middle finger, extending his fingertips and thumb to rest on the irregular surface pattern formed on the exterior portion of the lower cavity 140. Percussion is accomplished by moving in direction 172, the open end 148 of cavity 140 against the skin area of desired contact. Pressure from the therapist's hand is transmitted via shaft 156 which extends outwardly and flattens out in area 157 which couples shaft 156 to cavity 140. Note that the extending of shaft 156 into this form presents a large bottom piston-like area towards the skin contact area. This is to enhance the percussive effect. The most resilient area of the cavity enclosure are sidewall portions 159. Sidewalls 159 are textured or have a series of circumferential ridges to keep the fingers of the user from slipping.

The bottom dimension 141 of cavity 140 is approximately 6 mm in diameter while upper cavity 150 is approximately 3 mm. Shaft dimension 170 is approximately 2 mm while shaft dimension 174 is approximately 3 mm. Circular rings 112 and 114 are approximately 4.5 mm in diameter. Shaft dimension 181, 183 and 186 are approximately 1.5 mm, 2 mm, and 3.5 mm respectively. The total length is about 15 mm. Note that the shaft portion either above or below the circular rings could be deleted to provide only the holder and a single percussor cavity. However, adult and pediatric applications can generally be conveniently accommodated by two different sizes (one size cannot optimally accommodate all areas.) Since two different sizes are typically required, it is extremely useful and convenient to provide them both on the same appliance.

Figure 2:
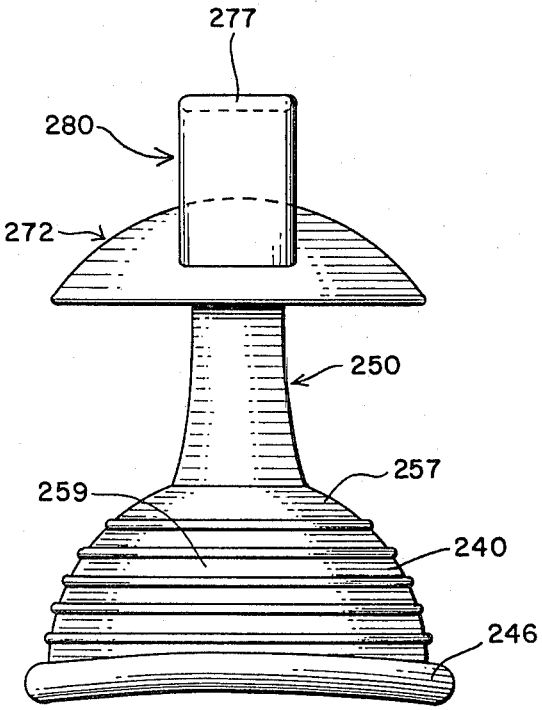
FIG. 2 is a side view of an alternate embodiment.

FIG. 2 illustrates percussive appliance which is adapted for one cup with a hand grip, which comprises a hemispherical portion 272 and a strap 277. This unit is held by placing the hand through the opening 280 between hemispherical portion 272 and strap 277. As before in the embodiment of FIG. 1, the fingertips and thumb are extended downward to engage and rest on the serrated raised pattern on the exterior of cup 240. Shaft 250 expands into area 257 when attaching to cup 240 and thus forms the wide aforementioned piston-like action which enhances the transmission of the percussive waves into the body area under treatment.

This particular embodiment also presents a curved surface for contact with the surface body area being treated. This is especially useful for percussing the sides of a person's body.

Figure 3A:
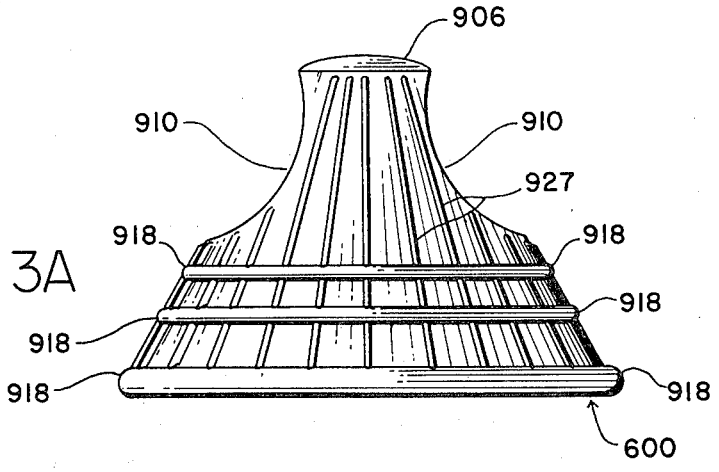
FIG. 3A is a side view and FIG. 3B is a perspective view of a third embodiment of the present invention.
Figure 3B:
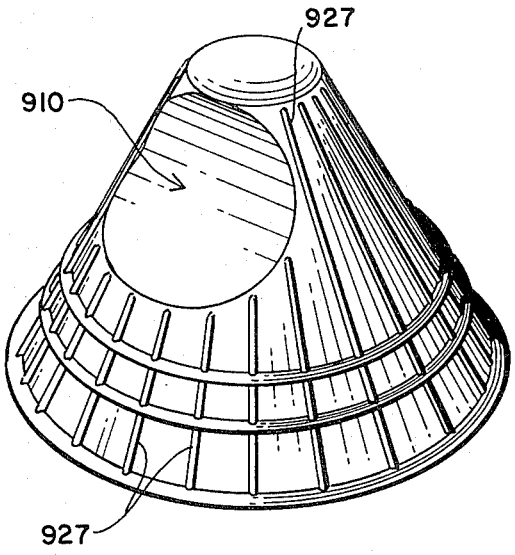

FIGS. 3A and 3B illustrate another embodiment of the present invention. Concave areas 910 provide a gripping surface which may be for the thumb and index finger or for placing between any two fingers. Raised circumferential rings 918 and vertical ribbing 927 are provided to retard slippage of the fingertips when one is grasping the device.

Figure 4:
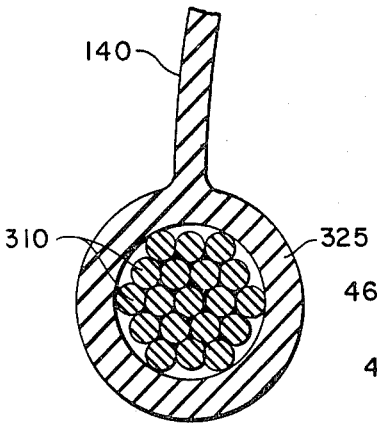
FIGS. 4, 5, and 6 are cross-sectional views of lips for use with the embodiments of the present invention.
Figure 5:
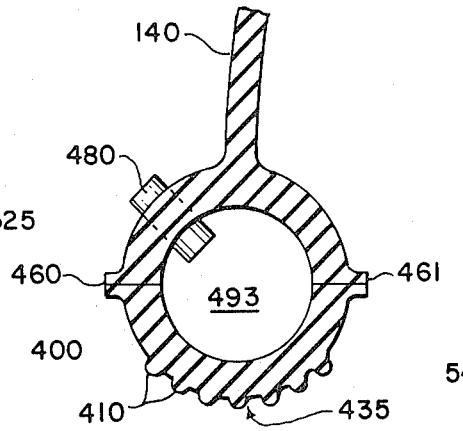
Figure 6:
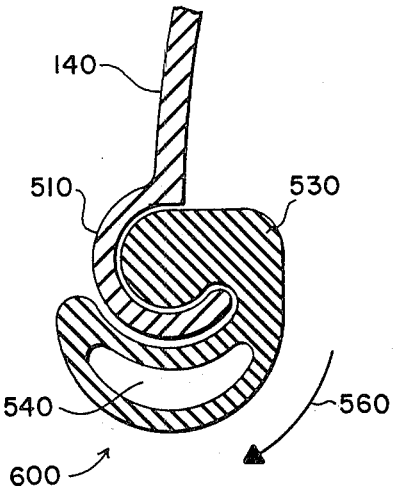

Referring now to FIGS. 4 through 6 there are shown a cross-sectional view of the lip structure for use with embodiments of the present invention. These designs provide a slip-free deformable lip structure which provides a pneumatic seal upon impact. In the embodiment of FIG. 4 the lip comprises a plurality of resilient cords 310 sealed within an outer lip layer 325. These cords are not coupled together and may slide over each other and thus spread this lip assembly to provide a large sealing area as the lip flattens on impact with the skin area.

FIG. 5 shows an alternate lip design. This design incorporates a cavity 493 having air and/or other compressible gaseous vapor contained therein. Upon contact with the skin, the lip deforms, spreading out and conforming to the body surface at the point of contact. A substantially airtight seal is thus formed between the percussive appliance and the skin surface contacted during percussion. Non-skid irregularities 410 may be optionally provided on the bottom 435 of lip 400. For babies and infants, the bottom surface 435 should be as smooth as possible since small surface irregularities would tear through the skin surface. Seam formations 460 and 461 are provided to increase the action of the lip to spread out as pressure is provided from above, rather than curling to one side or the other and providing little or no seal. For larger percussive devices an inflation valve 480 may be provided to vary the pressure within the lip.

FIG. 6 shows a third alternate lip design wherein lip structure 530 is coupled to sidewall 140 via a curved section 510. Lip structure 530 defines a groove therein to communicate with the interior and exterior portions of the curved section 510. Additionally, lip structure 530 defines a cavity 540 therewithin. Cavity 540 can be filled with a liquid or a compressible gaseous vapor to allow the deformation of lip structure 530 to form a seal of lip structure 530 with the body area of the patient. Note that the greatest portion of the lip is actually inside the greatest effective diameter of sidewall 140 and is slightly angled to cause it to roll in the direction shown by arrow 560 in response to impact with the skin area.

The above-described or alternate lip designs in the preferred embodiment are designed to minimize the surface injury from impact of the percussive appliance while maximizing the transmission of percussive energy waves into the body area being treated by forming the aforementioned substantially airtight seal. In this way the percussive impact is transferred into the body over the entire surface area covered by the appliance rather than just at the points of physical coupling of the device and the skin surface of the patient being treated.

What is claimed is:

1. A medical appliance for use in percussive respiratory therapy, said apparatus comprising:

an open ended cup-like enclosure means in the shape of a truncated cone for substantially sealing pneumatically with the body surface of a person by resiliently conforming to the body contour upon impact;

a portion of said cone being adapted to provide gripping means for the user, said gripping means including:

two opposing concave regions on opposite sides of the cone for holding it between two fingers; and surface irregularities on the substantially planar exterior surface below the concave regions for enhancing the grippability of the appliance with the other fingers of the user;

said open end of the cone defining an inward curling semi-circular lip; and a resiliently deformable annular ring defining a groove therein to communicate with the interior and exterior portions of said curling semi-circular lip, said annular ring also defining a cavity filled with compressible gasseous vapor in the portion of the ring in communication with the exterior portion of the curling semi-circular lip, for cushioning the impact of said appliance upon the body of a patient.

2. The medical appliance as in claim 1 wherein the surface of said open-ended portion is contoured to substantially conform to a predetermined body area.

* * * * *